US007344149B2

(12) United States Patent
Leitner

(10) Patent No.: US 7,344,149 B2
(45) Date of Patent: Mar. 18, 2008

(54) SKI, IN PARTICULAR AN ALPINE SKI

(75) Inventor: Wolfgang Leitner, Uttendorf (AT)

(73) Assignee: Blizzard Sport GmbH, Mittersill (AT)

( * ) Notice: Subject to any disclaimer, the term of this patent is extended or adjusted under 35 U.S.C. 154(b) by 120 days.

(21) Appl. No.: 11/047,452

(22) Filed: Jan. 31, 2005

(65) Prior Publication Data

US 2005/0212259 A1 Sep. 29, 2005

(30) Foreign Application Priority Data

Jan. 29, 2004 (DE) ..... 20 2004 001 356 U

(51) Int. Cl.
*A63C 5/00* (2006.01)

(52) U.S. Cl. ..... 280/607; 280/617

(58) Field of Classification Search ..... 280/607, 280/609, 611, 617, 11.14
See application file for complete search history.

(56) References Cited

U.S. PATENT DOCUMENTS

| | | | | |
|---|---|---|---|---|
| 3,198,537 | A | 8/1965 | Silberman | |
| 4,022,491 | A * | 5/1977 | Powell | 280/618 |
| 4,499,674 | A * | 2/1985 | Olivieri | 36/117.3 |
| 5,297,812 | A * | 3/1994 | Dogat et al. | 280/633 |
| 5,338,051 | A * | 8/1994 | Szafranski et al. | 280/607 |
| 5,575,496 | A * | 11/1996 | Luitz et al. | 280/618 |
| 5,836,604 | A * | 11/1998 | Piegay | 280/607 |
| 5,944,336 | A * | 8/1999 | Fagot | 280/607 |
| 6,227,558 | B1 * | 5/2001 | Arduin et al. | 280/611 |
| 6,641,162 | B2 * | 11/2003 | Allmann et al. | 280/607 |
| 6,779,810 | B1 * | 8/2004 | Mangold | 280/634 |
| 6,814,367 | B2 * | 11/2004 | Mercier et al. | 280/613 |
| 2003/0146599 | A1 | 8/2003 | Stefanova et al. | |

FOREIGN PATENT DOCUMENTS

| | | |
|---|---|---|
| AT | 411152 B | 3/2003 |
| DE | 10062884 | 5/2002 |
| EP | 0758557 | 2/1997 |
| EP | 1240925 | 9/2002 |
| EP | 1314458 | 5/2003 |
| EP | 1366785 | 12/2003 |
| WO | 02/49728 | 6/2002 |

* cited by examiner

*Primary Examiner*—Christopher Bottorff
(74) *Attorney, Agent, or Firm*—Dilworth & Barrese LLP

(57) ABSTRACT

The invention relates to a ski, in particular an alpine ski, with a basic ski body and a binding plate. According to the invention, lateral guide elements are positioned in the mid-section of the basic ski body where the binding plate is to be inserted, and these lateral guide elements each form a lateral guide groove for the binding plates that are inserted in a form-fitting manner between them.

19 Claims, 10 Drawing Sheets

SKI, IN PARTICULAR AN ALPINE SKI

BACKGROUND OF THE INVENTION

The invention relates to a ski, in particular an alpine ski, with a basic ski body and a binding plate. In particular, the invention relates to the particular design of a ski for holding binding elements adapted to it.

In the latest ski designs, the binding holder is integrated into the ski body, with the goal of providing improved force transfer and a better lengthwise balance during deflection.

Binding plate systems using a variety of fastening methods are known from the prior art. The plates are usually firmly attached to the mid-section of the ski. The free-sliding ends allow for a free deflection of the ski.

Other systems are also known, in which free sliding is enabled by means of profiled track systems. Tracks to be attached to the ski surface, which form the holder for the binding plate, are screwed or glued on in the area of the binding. An example of this type of design from the prior art is shown in FIG. 1 attached in the Appendix. This embodiment shows a Ski 1 with a normal structure. The ski has a core 7, a coating 5, a bottom chord 6, a top chord 8, a surface 9, and steel edges 4. Track guides 10, designed as plastic tracks, are also screwed onto surface 9. As shown in FIG. 1, they have a swallow-tail shape that engages with a corresponding lengthwise recess in the binding plate set onto the track guides. In this design, all forces are transferred via the tracks.

A drawback of this embodiment of the prior art is that retardations occur due to additional elements between the ski and the binding plate, and the force transfer may negatively impact the ski characteristics due to the play between the various elements. In addition, the frictional forces that arise in the deflection of the ski cannot be eliminated with these kinds of solutions of the prior art.

Fastening systems of this kind are described, for example, in EP 1314458 A1 and DE 10062884 A1.

A ski is known from Austrian patent AT 411152 in which two outer slits enable the holding of the binding. The bearing surface of the binding plate lies directly above the steel edge on the outside of the ski. The basic ski body is notched on the sides and the binding plate is guided along the side undercut. The support surfaces are above the steel edges.

In EP 1366785 A1, two grooves are described running along the length of the ski, which are open on the sides facing away from one another. In addition, the width of the mounting mechanism is between 50% and 95% of the narrowest width of the basic ski body.

The last embodiments described share in common that the binding plate is guided in grooves facing outward toward the side edges of the ski, which negatively impacts the bending rigidity of the entire system consisting of the binding plate and the basic ski body.

SUMMARY OF THE INVENTION

The task of the invention is to design the holder for a binding plate or binding elements in general in the basic ski body in such a way that force transfer losses are minimized and a free deflection of the ski is ensured.

This task is solved according to the invention through the combination of characteristics herein. According to it, lateral guide elements are positioned in the mid-section of the basic ski body where the binding plate is to be inserted, and these lateral guide elements each form a lateral guide groove for the binding plate that is inserted in a form-fitting manner between them. According to this solution, the guide of the binding plate is integrated into the inside of the basic ski body, so that the bending rigidity of the overall system is no longer affected. Unlike the previously mentioned prior art, the binding plate no longer encompasses the guide elements, but rather it is guided between them in the corresponding grooves provided for this purpose. The guide and holder of the binding plate is centrally integrated in the binding mount area of the basic ski body. The bearing surface of the binding plate is located inside of the ski and therefore contacts the basic ski body directly.

With the present solution, the lateral exterior surfaces of the ski are advantageously pulled upward and the middle portion of the ski cross-section is just as shallow as or shallower than in a comparable conventional ski. In this way, a corresponding rigidity loss due to the cut-out is compensated for. The height of the ski can be from 5 to 15 mm thicker than in conventional designs. As shown particularly in the racing field, this standing height increase results in a better edge grip and a stronger laying-on-edge of the ski, which improves the handling especially when used in sport skiing.

The ski design according to the invention makes it possible to slide a binding system onto the ski along with the binding plate. Using a central fastening screw, the binding plate with the binding system can be secured against sliding in the lengthwise direction. The separate holder elements are connected to one another in the lengthwise direction and can move along the guide elements during the deflection of the ski.

Preferred embodiments of the invention are found in the following description.

According to them, the guide elements constituting the guide grooves can be distinct components that are inlaid into the surface of the basic ski body and glued to it.

The guide elements constituting the guide grooves can be integrated parts of a three-dimensionally molded basic ski body.

The binding plate can rest on the surface of the basic ski body. On the other hand, the binding plate can be held only in the area of the lateral guide groove. Finally, the binding plate can rest on the surface of the basic ski body and the area of the lateral guide grooves.

The binding plate engages with the corresponding groove of the guide elements so that an inward-facing overlap occurs in the mid-section of the basic ski body. The inner bearing surface is pushed as far outward as possible, so that the overall edge grip of the ski is further improved. Due to the orientation toward the inside of the ski of the grooves for holding the guide plate [sic], the contact of the guide plate with the guide elements is largely protected from crud and mechanical damage.

According to another advantageous embodiment, the binding plate can be supported on the sides in an elastic manner.

By using special materials for the surface in the binding plate area or even the guide elements, the load progression in the overall ski can be directly affected. Thus, for example, by using steel or similarly hard materials, for example fiber-reinforced composite materials, the torsion-resistance in this segment can be increased considerably. Conventional ski materials can still be used for the design in the tip or tail of the ski.

The binding plate can be made of metallic material or, alternatively, of thermoplastic plastics. The binding plate or the groove-like overlap by the guide elements may be a part of the binding housing.

The binding plate may overhang on both sides.

BRIEF DESCRIPTION OF THE DRAWINGS

Additional details and advantages of the invention are shown in the design embodiments depicted in the drawings, of which.

DESCRIPTION OF THE PREFERRED EMBODIMENTS

Figure 1:
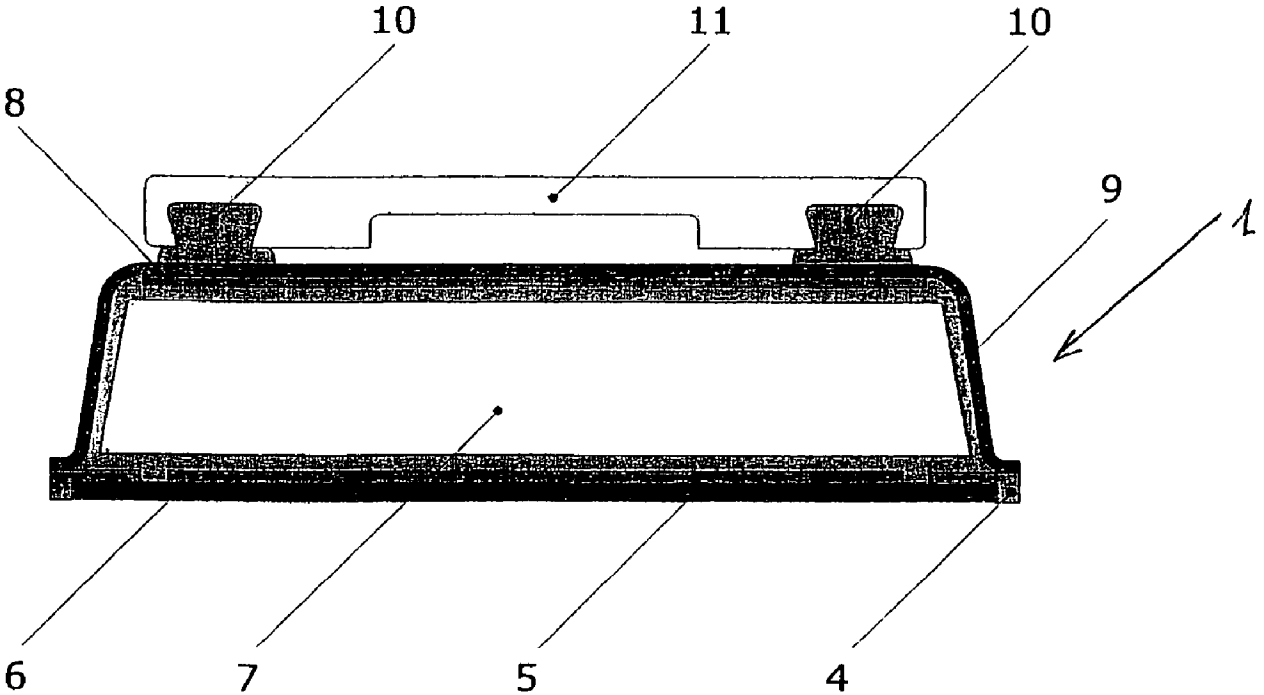
Fig. 1 PRIOR ART
FIG. 1: shows a cross-section of a ski with a screwed-on track guide and binding plate according to the prior art.
Figure 2:
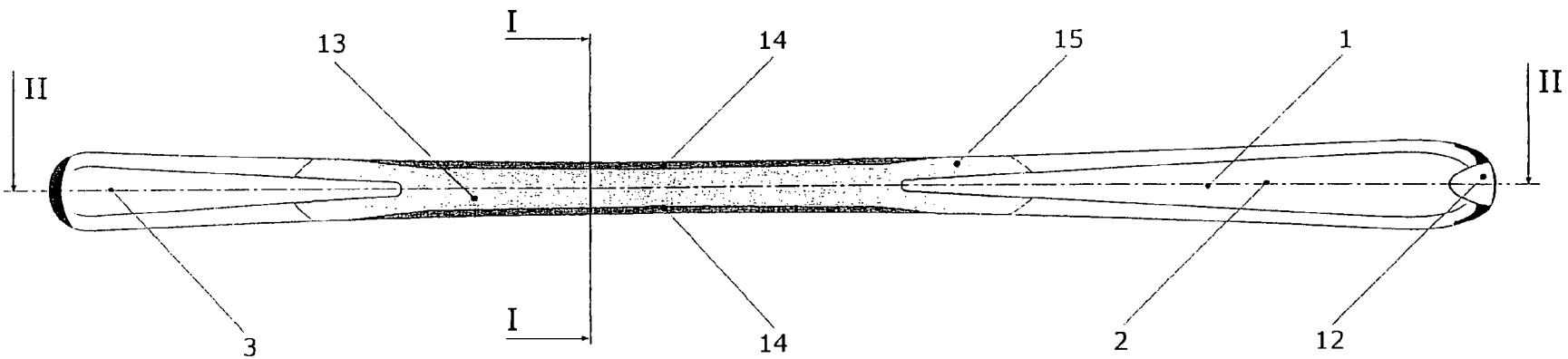
FIG. 2: shows a top view of a ski in a design embodiment according to the invention.
Figure 3:
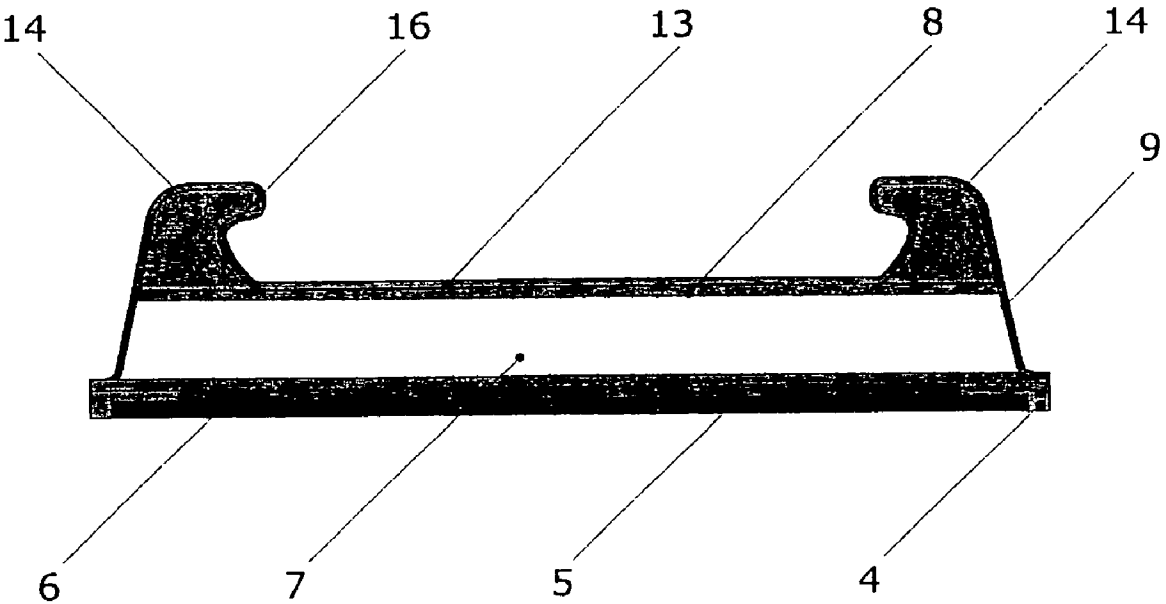
FIG. 3: shows a section along line I-I in FIG. 2, FIG. 4: shows a view as in FIG. 3, in a modified embodiment (without the binding plate being placed in position)

FIG. 2 shows a ski 1 according to the invention with a tip area 2 and a tail area 3, with an attachable tip 12 provided in the tip area. The basic ski body is shown without the binding plate in this view. The basic ski body has lateral guide elements 14 that, as shown in FIG. 3, can be provided as distinct separate components that can be inlaid into the surface of the basic ski body and glued to it. This design variant is shown in FIG. 3, which shows a cross-section of a normal ski structure with a core 7, a coating 5, side edges 4, a bottom chord 6, a top chord 8, and a surface 9. Surface 9 encompasses corresponding guide elements 14, as shown here, which have undercuts or grooves 16 facing the inside of the ski. The bearing surface on the basic ski body is marked 13.

Figure 4:
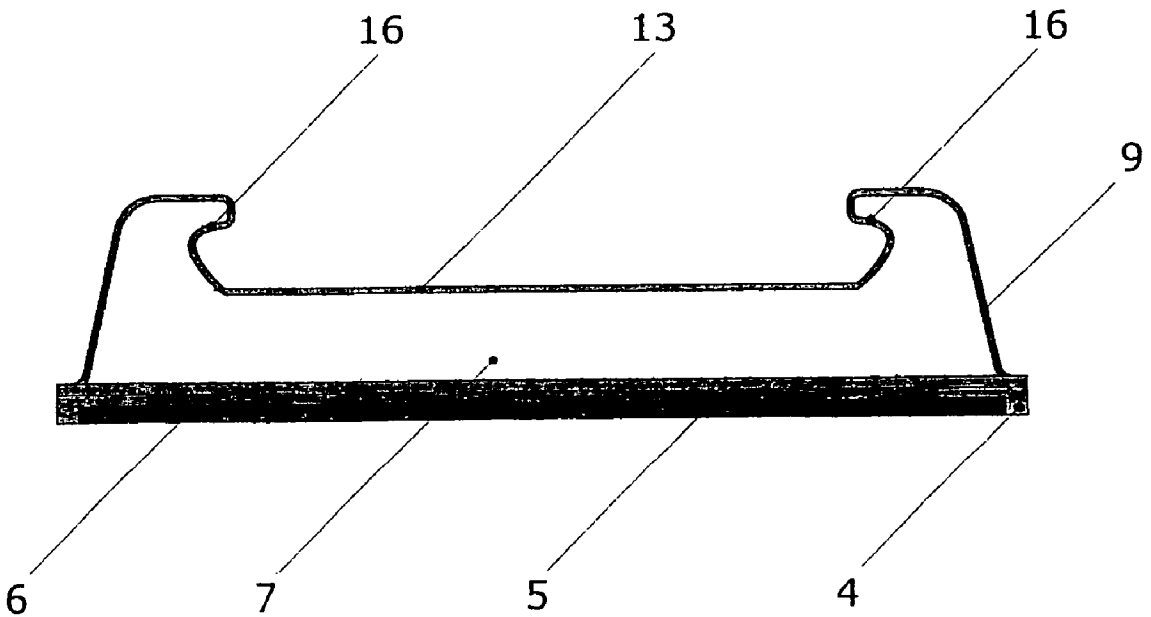
Figure 5:
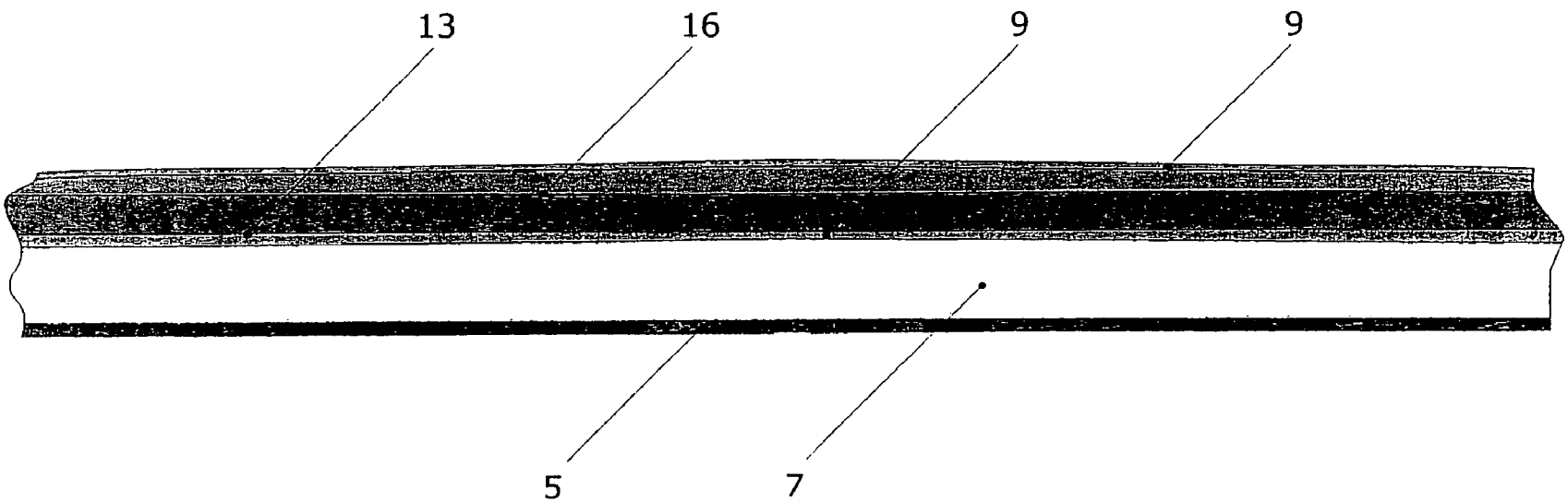
FIG. 5: shows a lengthwise section along section line II-II in FIG. 2 (without the binding plate being placed in position)

In the embodiment of FIG. 4, the guide elements are designed as integrated components of core 7. Otherwise, the structure is the same as that described above. FIG. 5 shows the lengthwise cross-section of FIG. 2, with the binding plate not yet inserted, similar to FIG. 2.

FIGS. 6 to 10 show various binding plates 17. In the design embodiment of FIG. 6, the binding plate rests on surface 13 of the basic ski body, with this bearing being designed to occur only in the area close to the groove. In this case, the bearing surface is thus pushed as far outward as possible, so that the edge grip is even further improved.

Figure 7:
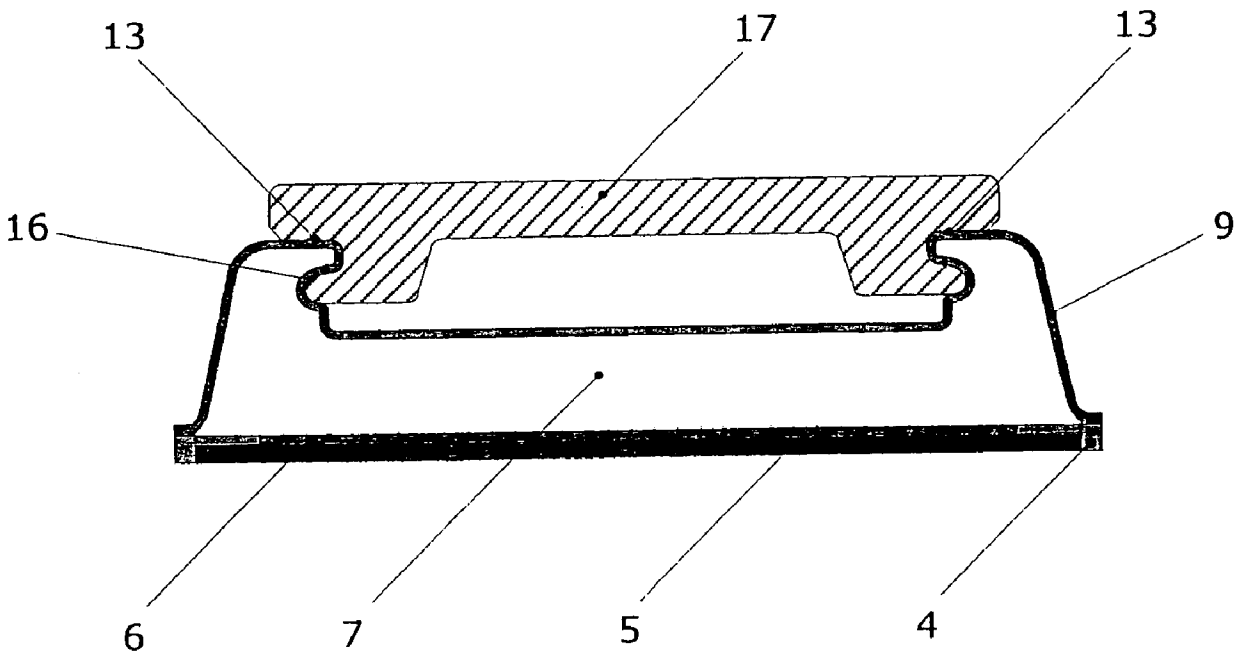
FIG. 7: shows a view as in FIG. 6 of a modified design variant of the invention.
Figure 8:
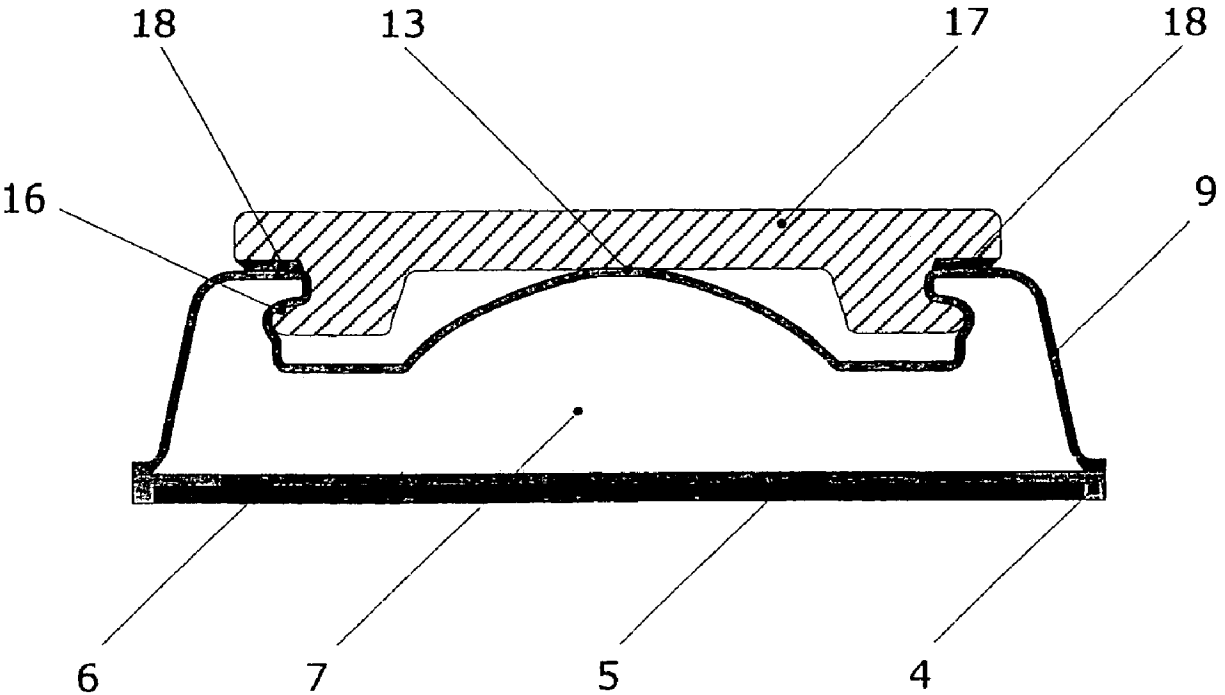
FIG. 8: shows a view of the invention as in FIG. 6 according to another alternative design variant.

As an alternative to this solution, in FIG. 7 binding plate 17 is designed only in the area of grooves 16 and in the upper area of the guide elements, with the corresponding bearing surface of binding plates 17 being shown here in the upper area of the guide elements and being marked 13. An elastomer insert can be positioned on both sides in this area, as shown in FIG. 8 in another design embodiment of the invention. In order to ensure the stability of the binding plate, the inner area of core 7 with surface 9 is arched so that a contact-bearing surface is created in the middle section of the basic ski body, on which binding plate 17 rests. The overall design is arranged in such a way that a certain degree of motion of the ski plate is possible depending on the load displacement.

Figure 9:
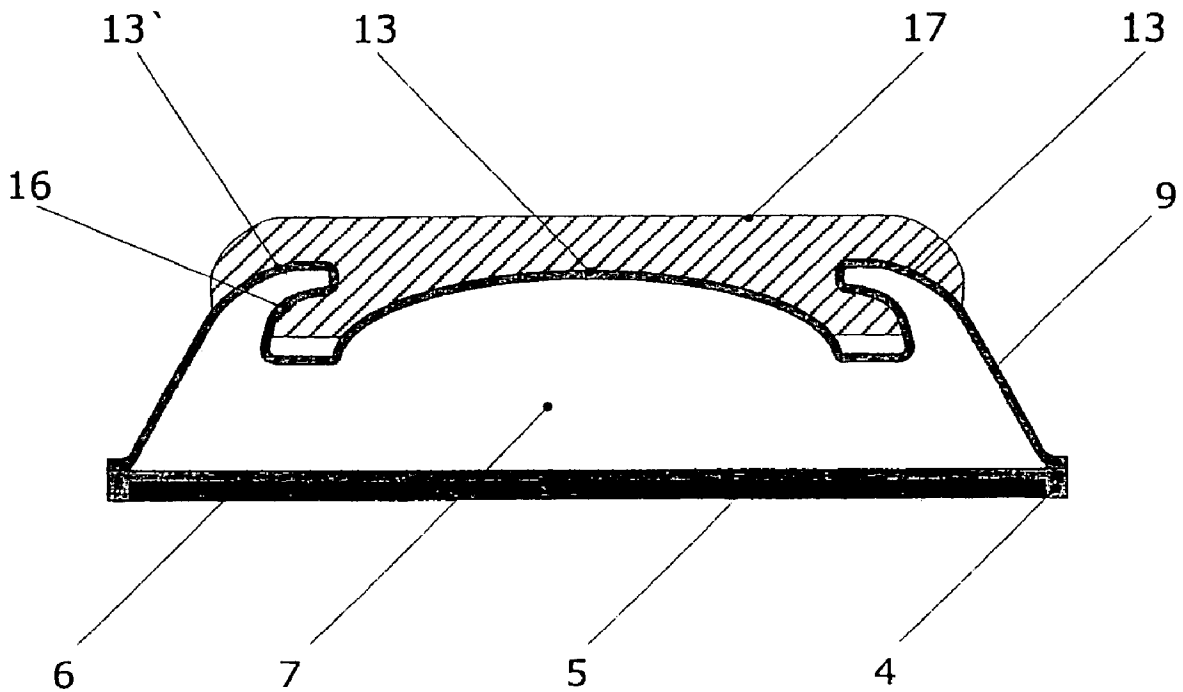
FIG. 9: again shows an alternative design variant of a presentation as in FIG. 6, once again in a modified design embodiment.

Another embodiment of the invention is shown in FIG. 9, in which, in contrast to the design variant of FIG. 8, binding plate 17 lies largely flat on arched surface 9 of core 7 and on the surface of the guide elements. Here the bearing surfaces are marked 13 and 13'.

Figure 6:
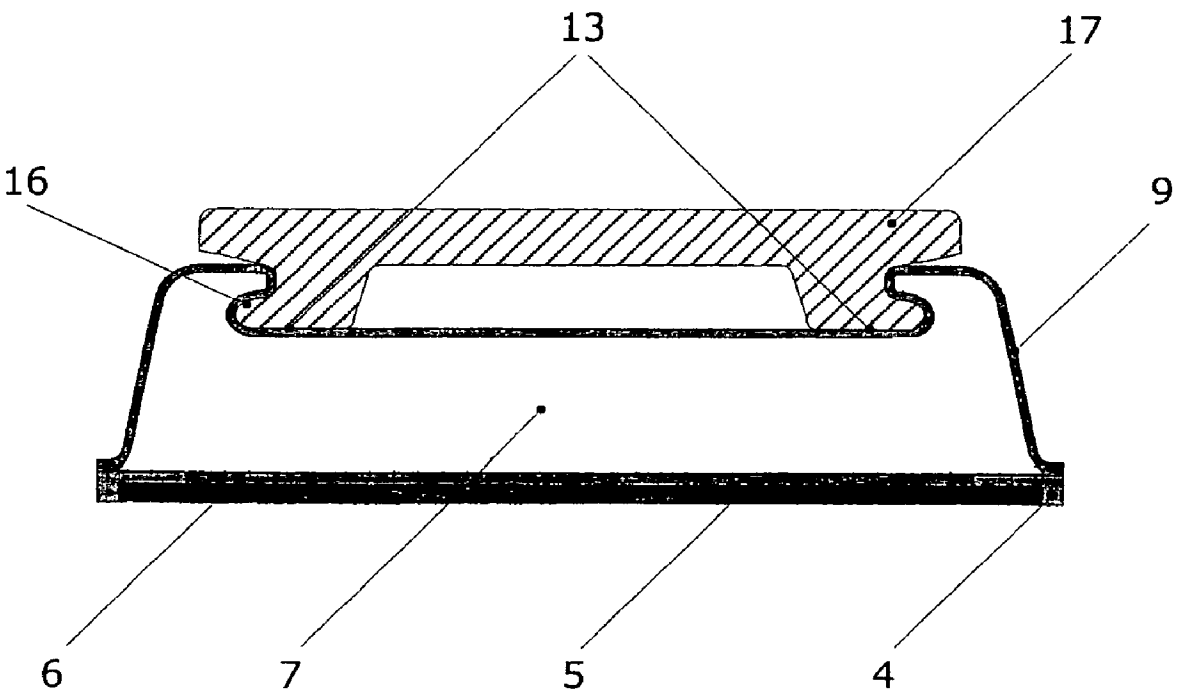
FIG. 6: shows a cross-sectional view as in FIG. 4 with the binding plate inserted.
Figure 10:
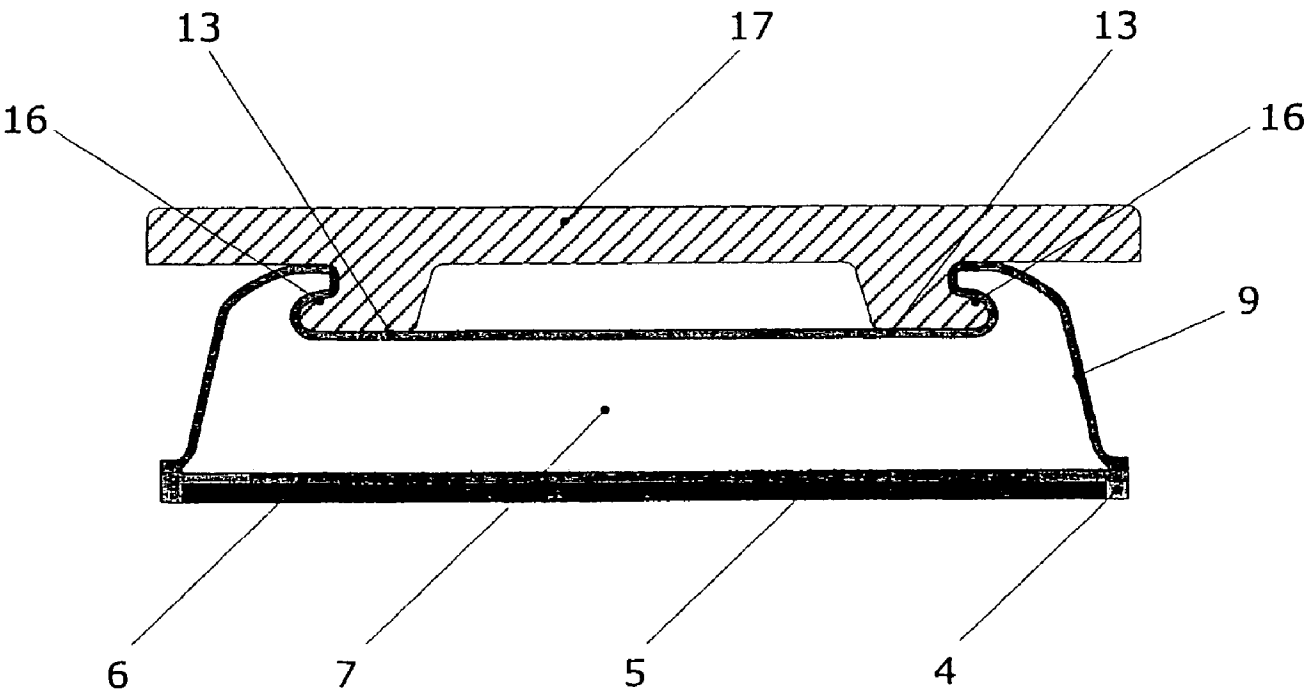
FIG. 10: again shows an alternative design embodiment as in FIG. 6 with an overhanging binding plate.

Another alternative embodiment of the invention is shown in FIG. 10, which largely matches that of FIG. 6 as it relates to the support of the binding plate. However, in this case a binding plate 17 with overhanging side areas is depicted.

The invention claimed is:

1. Ski, comprising the combination of a basic ski body, a binding plate, and lateral guide elements positioned in the mid-section of the basic ski body where the binding plate is to be inserted, each said lateral guide element having a projection defining a laterally-extending guide groove between said projection and basic ski body, and said binding plate comprising a pair of laterally-extending grooves and projections, wherein the binding plate rests on the surface of the basic ski body, such that when said binding plate is inserted into said guide elements in a form-fitting manner, respective grooves of said guide elements mate with respective projections of said binding plate, and respective grooves of said binding plate mate with respective projections of said guide elements.

2. Ski of claim 1, wherein the guide elements constituting the guide grooves are distinct components that are inlaid into the surface of the basic ski body and glued to it.

3. Ski of claim 1, wherein the guide elements constituting the guide grooves are integrated parts of the three-dimensionally molded basic ski body.

4. Ski of claim , wherein the binding plate overhangs on both sides.

5. Ski of claim 1, wherein the surface of the basic ski body extending between the lateral guide elements is flat.

6. Ski of claim 1, wherein the binding plate is supported elastically on the sides.

7. Ski of claim 6, additionally comprising an elastomer insert positioned between the lateral guide grooves and binding plate.

8. Ski, comprising the combination of a basic ski body, a binding plate, and lateral guide elements positioned in the mid-section of the basic ski body where the binding plate is to be inserted, each said lateral guide element having a projection defining a laterally-extending guide groove between said projection and basic ski body, and said binding plate comprising a pair of laterally-extending grooves and projections, wherein the binding plate rests on the surface of the basic ski body and in the area of the lateral guide grooves, such that when said binding plate is inserted into said guide elements in a form-fitting manner, respective grooves of said guide elements mate with respective projections of said binding plate, and respective grooves of said binding plate mate with respective projections of said guide elements.

9. Ski of claim 8, wherein the binding plate is supported elastically on the sides.

10. Ski of claim 9, additionally comprising an elastomer insert positioned between the lateral guide grooves and binding plate.

11. Ski, comprising the combination of a basic ski body, a binding plate, and lateral guide elements positioned in the mid-section of the basic ski body where the binding plate is to be inserted, each said lateral guide element having a projection defining a laterally-extending guide groove between said projection and basic ski body, and said binding plate comprising a pair of laterally-extending grooves and projections, wherein the surface of the basic ski body extending between the lateral guide elements is upwardly-curved, and the binding plate is only supported upon a middle section of the surface of the basic ski body extending between the lateral guide elements, such that when said binding plate is inserted into said guide elements in a form-fitting manner, respective grooves of said guide elements mate with respective projections of said binding plate, and respective grooves of said binding plate mate with respective projections of said guide elements.

12. Ski of claim 11, wherein the binding plate overhangs on both sides.

13. Ski of claim 11, wherein the binding plate mates with the upwardly-curved surface in complementary manner.

14. Ski, comprising a basic ski body, a binding plate, and lateral guide elements positioned in the mid-section of the basic ski body where the binding plate is to be inserted, these lateral guide elements each forming a lateral guide groove for the binding plate that is inserted in a form-fitting manner between them, and outer lateral sides of both said basic ski body and lateral guide elements each forming a substantially smooth, straight, continuous outer lateral surface, wherein the surface of the basic ski body extending between the lateral guide elements is upwardly-curved, and the binding plate is only supported upon a middle section of the surface of the basic ski body extending between the lateral guide elements.

15. Ski of claim 14 wherein the binding plate is supported elastically on the sides.

16. Ski of claim 15, additionally comprising an elastomer insert positioned between the lateral guide grooves and binding plate.

17. Ski of claim 14, wherein the binding plate is made of a metallic material, such as steel or aluminum, or of carbon-fiber-reinforced plastics (CFPs), glass-fiber-reinforced plastics (GRPs), short-fiber-reinforced plastics (SMT), or glass-mat-reinforced plastics (GMT), or of thermoplastic surface materials.

18. Ski of claim 14, wherein the binding plate overhangs on both sides.

19. Ski of claim 14, wherein the binding plate mates with the upwardly-curved surface in complementary manner.

* * * * *